US005104292A

United States Patent [19]

Koepsel et al.

[11] Patent Number: 5,104,292

[45] Date of Patent: Apr. 14, 1992

[54] MARINE PROPELLER WITH PERFORMANCE PITCH, INCLUDING FIVE BLADE VERSION

[75] Inventors: Roger E. Koepsel; Ronald M. Steiner, both of Oshkosh, Wis.

[73] Assignee: Brunswick Corporation, Skokie, Ill.

[21] Appl. No.: 450,620

[22] Filed: Dec. 13, 1989

[51] Int. Cl.[5] ..... B63H 1/26

[52] U.S. Cl. ..... 416/223 R; 416/243; 416/DIG. 2; 416/DIG. 5

[58] Field of Search ..... 416/223 R, 234, 242, 416/243, 235, 239, DIG. 2, DIG. 5

[56] References Cited

U.S. PATENT DOCUMENTS

| | | | |
|---|---|---|---|
| 1,019,437 | 3/1912 | Draper | 416/243 |
| 1,455,591 | 5/1923 | Lawson | 416/243 |
| 1,639,785 | 8/1927 | Sepulveda | 416/243 |
| 2,047,847 | 7/1936 | Ambjornson | 416/243 |
| 2,090,888 | 8/1937 | Gill | 416/243 |
| 2,524,870 | 10/1950 | Adamtchik | 416/243 |
| 3,312,286 | 4/1967 | Irgens | 416/197 R |
| 3,640,642 | 1/1971 | Kress | 416/93 A |
| 3,697,193 | 10/1972 | Phillips | 416/223 |
| 4,073,601 | 2/1978 | Kress | 416/242 |
| 4,080,099 | 3/1978 | Snyder | 416/146 R |
| 4,331,429 | 5/1982 | Koepsel et al. | 416/223 R |
| 4,632,636 | 12/1986 | Smith | 416/223 R |
| 4,775,297 | 10/1988 | Bernauer | 416/242 |
| 4,802,822 | 2/1989 | Gilgenbach et al. | 416/235 |
| 4,802,872 | 2/1989 | Stanton | 416/93 A |

FOREIGN PATENT DOCUMENTS

| | | | |
|---|---|---|---|
| 312482 | 5/1929 | United Kingdom | 416/242 |
| 435993 | 10/1935 | United Kingdom . | |
| 2151713 | 7/1985 | United Kingdom . | |

OTHER PUBLICATIONS

"Everything You Need To Know About Propellers", Third Edition; Mercury Marine, Brunswick Corporation, OS5-384, 10-M, Part No. 90-86144, 1984.

Columbian Bronze Corp. Cat. (1968), p. 6, "Pentadyne".

*Primary Examiner*—John T. Kwon

*Attorney, Agent, or Firm*—Andrus, Sceales, Starke & Sawall

[57] ABSTRACT

A marine propeller (100) combines progressive pitch with both increasing pitch and increasing progressiveness of pitch along at least a portion of increasing radii from the axis of rotation to the outer blade tip. A five blade propeller is provided which accommodates thermal warpage of the outer blade tips, such that the same propeller includes two different types of blades, one blade having increasing pitch with increasing radii all the way to the outer blade tip, and the other type of blade having increasing pitch to a given radius and then decreasing pitch with increasing radii to the outer blade tip. The latter blade type is preferred and has a hump in the pressure surface at the noted given radius between portions of increasing and decreasing pitch with increasing radii.

2 Claims, 3 Drawing Sheets

FIG. 6
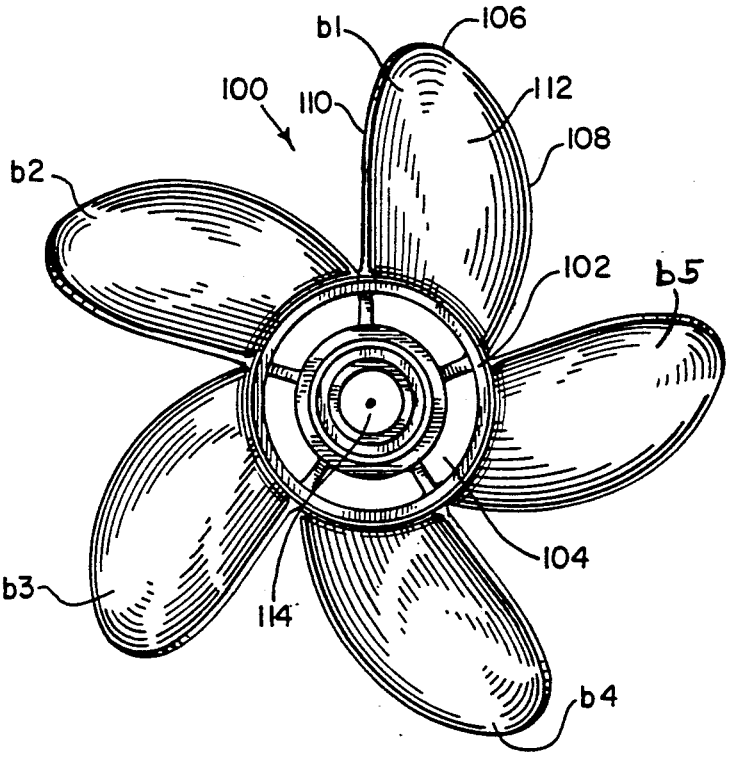
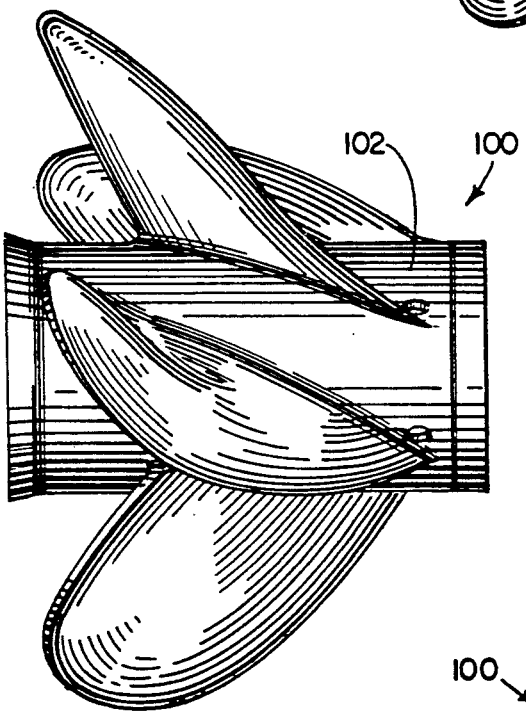
FIG. 7
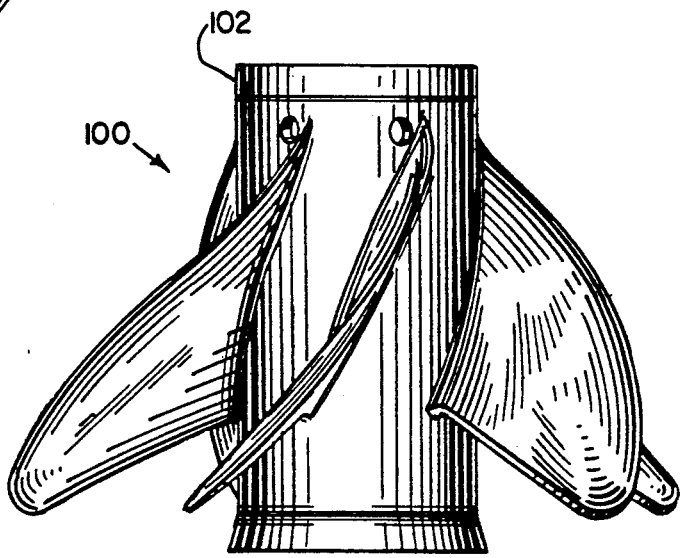
FIG. 8

MARINE PROPELLER WITH PERFORMANCE PITCH, INCLUDING FIVE BLADE VERSION

BACKGROUND AND SUMMARY

The invention relates to optimized performance marine propellers. The invention arose during continuing efforts further developing the subject matter of U.S. Pat. No. 4,802,822, incorporated herein by reference, and efforts directed to developing a five blade marine propeller.

The invention provides a particular blade pressure surface contour, and is particularly advantageous in a five blade propeller. For further background regarding marine propeller blade design, reference is made to "Everything You Need To Know About Propellers", Third Edition, Mercury Marine, Brunswick Corporation, QS5-384-10M, Part No. 90-86144, 1984, and to U.S. Pat. Nos. 3,312,286, 4,073,601, 4,080,099, 4,331,429, and 4,632.636.

BRIEF DESCRIPTION OF THE DRAWINGS

FIG. 6 is a rear view of the propeller of FIG. 1.

FIG. 7 is a left side view of the propeller of FIG. 1.

FIG. 8 is a bottom view of the propeller of FIG. 1.

DETAILED DESCRIPTION

Figure 1:
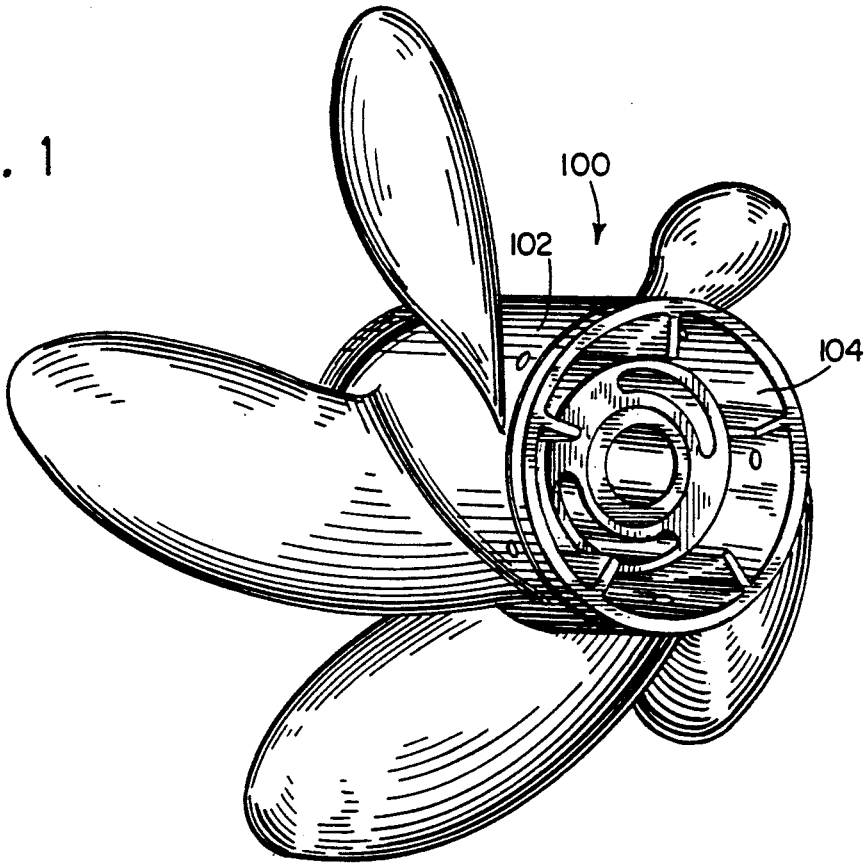
FIG. 1 is a front perspective view of a marine propeller in accordance with the invention
Figure 2:
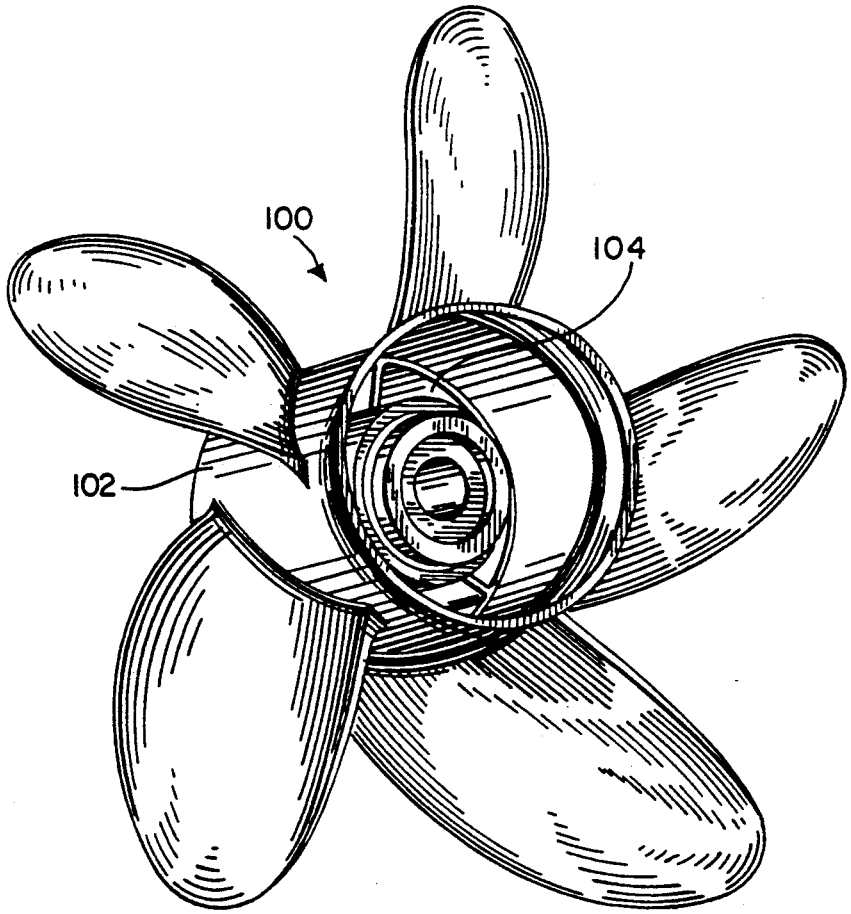
FIG. 2 is a rear perspective view of the propeller of FIG. 1.

The drawings show a propeller 100 for a marine lower drive unit as shown in FIG. 1 of incorporated U.S. Pat. No. 4,802,822. Propeller 100 includes a hub 102 with a through-hub-exhaust passage 104, as known in the art, and which is optional. Propeller hub 102 has five blades b1, b2, b3, b4, b5, extending ,generally radially outwardly therefrom to respective outer tips such as 106, FIG. 6. Each blade has a leading edge 108 and a trailing edge 110. Each blade has a high pressure surface 112 defined between hub 102 and outer tip 106 and between leading edge 108 and trailing edge 110.

As known in the art, for example pages 6 and 7 of the above noted "Everything You Need To Know About Propellers", Mercury Marine, pitch is defined by the axial distance a point on the blade pressure surface travels in one revolution of the propeller if it were traveling through a soft solid, like a screw in wood. The higher the pitch, the more axial movement of the propeller or screw per revolution. Progressive pitch is the change of pitch from leading edge to trailing edge along a given radius from the hub, and is known in the art. Progressive pitch starts low at the leading edge and progressively increases to the trailing edge, pages 6 and 7 of the above noted "Everything You Need To Know About Propellers", Mercury Marine. For example, FIG. 8*a* on page 7 of the noted "Everything You Need To Know About Propellers", Mercury Marine, shows one type of blade with a constant pitch of 21 inches, and also shows another type of blade with progressive pitch starting at 19 inches at the leading tip and then increasing to 20 inches and then to 21 inches and then to 22 inches and then to 23 inches at the trailing edge.

Figure 3:
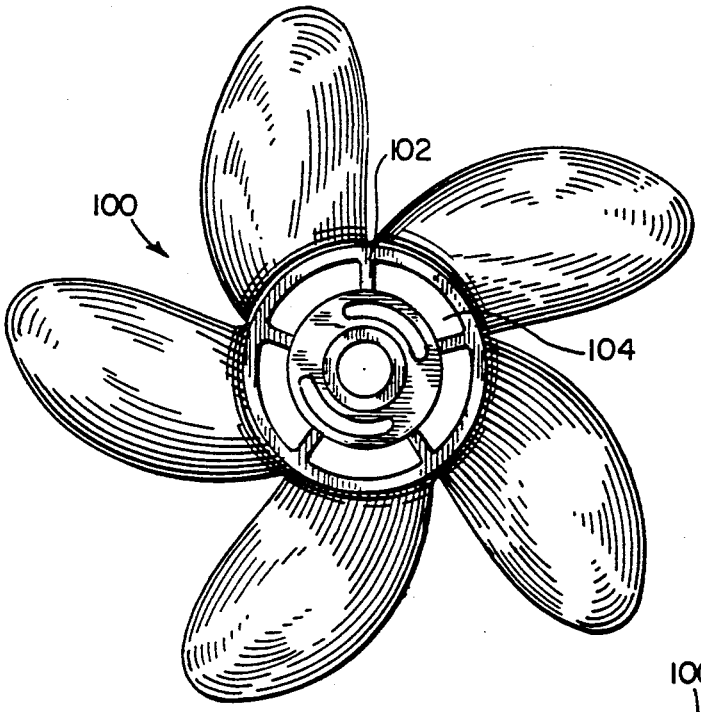
FIG. 3 is a front view of the propeller of FIG. 1.

The propeller of the present invention and the propeller of incorporated U.S. Pat. No. 4,802,822 utilize progressive pitch from leading edge to trailing edge along a given radius from the axis of rotation of the propeller. This is illustrated in FIG. 3 of incorporated U.S. Pat. No. 4,802,822, where the pitch at area 28 of pressure surface 26 of the blade is higher than the pitch at area 30 which in turn is higher than the pitch at area 32, thus providing a progressive pitch, i.e. pitch increases from leading edge 22 to trailing edge 24. Progressive pitch defines a concave camber from leading edge to trailing edge wherein the more progressive the pitch the more the camber, i.e. the more concavity. A straight line from leading edge 22 to trailing edge 24 defines a chord 34. The maximum transverse dimension 36 from chord 34 to blade pressure surface 26 relative to the chord length defines the degree of camber or concavity.

Figure 4:
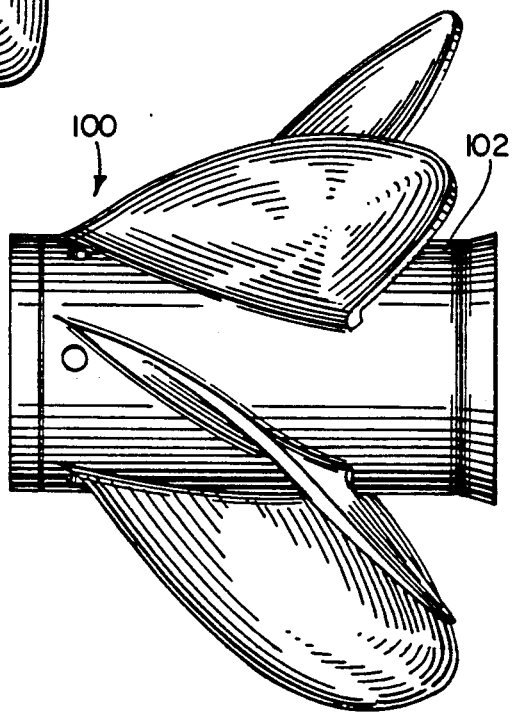
FIG. 4 is a right side view of the propeller of FIG. 1.
Figure 5:
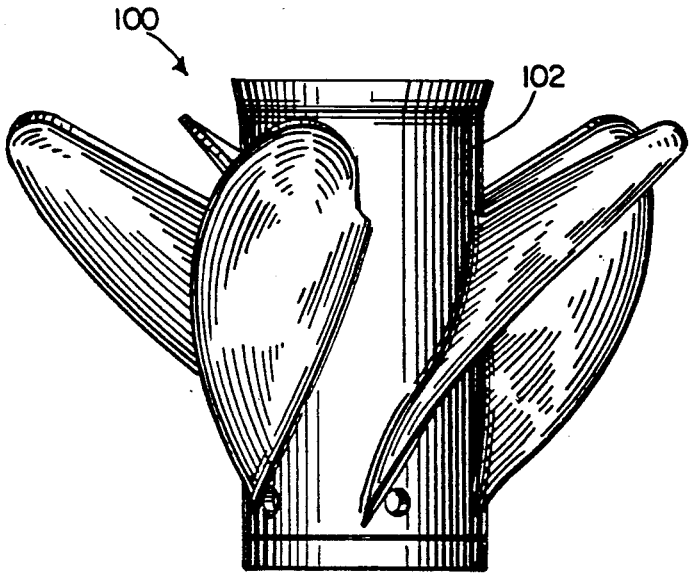
FIG. 5 is a top view of the propeller of FIG. 1.

The propeller of the present invention and the propeller of incorporated U.S. Pat. No. 4,802,822 utilize increasing progressiveness of pitch with increasing radii toward the outer tip of the blade. FIG. 3 of incorporated U.S. Pat. No. 4,802,822 shows a cross section of the blade relatively close to the hub. FIG. 4 shows a cross section in a central portion of the blade. FIG. 5 shows a cross section near the outer portion of the blade. Dimension 46 in FIG. 4 is the maximum transverse dimension from chord 34*a* to blade pressure surface 26. Dimension 48 in FIG. 5 is the maximum transverse dimension from chord 34*b* to blade pressure surface 26. The ratio of transverse dimension 46 to the length of chord 34*a* is greater than the ratio of transverse dimension 36 to the length of chord 34. The ratio of transverse dimension 48 to the length of chord 34*b* is greater than the ratio of transverse dimension 46 to the length of chord 34*a*. The progressiveness of pitch increases with increasing radii and defines increasing camber.

The propeller of the present invention departs from that of incorporated U.S. Pat. No. 4,802,822 in that the present propeller provides increasing pitch with increasing radii. In contrast, the propeller of incorporated U.S. Pat. No. 4,802,822 has decreasing pitch with increasing radii.

In the present invention, the pressure surface 112 of the blade has a progressive pitch from leading edge 108 to trailing edge 110 along a given radius from the axis 114 of rotation of the propeller, in combination with both increasing pitch and increasing progressiveness of pitch along at least a portion of increasing radii from such given radius.

The following table shows the pitch readings for each of the five blades of a 12.75 inch diameter propeller, at radii of 3 inches, 4 inches, 5 inches, and 6 inches from the axis 114 of rotation.

| Blade | 3" radius | 4" radius | 5" radius | 6" radius |
|---|---|---|---|---|
| b1 | 23.3 | 23.5 | 23.7 | 24.2 |
| b2 | 22.9 | 23.0 | 23.4 | 23.0 |
| b3 | 23.1 | 23.3 | 23.9 | 24.0 |
| b4 | 22.9 | 22.9 | 23.1 | 23.0 |
| b5 | 23.1 | 23.2 | 23.3 | 23.0 |

For blade b1, pitch increases from 23.3 inches at a 3 inch radius to 23.5 inches at a 4 inch radius to 23.7 inches at a 5 inch radius to 24.2 inches at a 6 inch radius. For blade b2, pitch increases from 22.9 inches at a 3 inch radius to 23.0 inches at a 4 inch radius to 23.4 inches at a 5 inch radius and then decreases to 23.0 inches at a 6 inch radius. For blade b3, pitch increases from 23.1 inches at a 3 inch radius to 23.3 inches at a 4 inch radius to 23.9 inches at a 5 inch radius to 24.0 inches at a 6 inch radius. For blade b4, pitch increases from 22.9 inches at the 3 and 4 inch radii to 23.1 inches at a 5 inch radius and then decreases to 23.0 inches at a 6 inch radius. For blade b5, pitch increases from 23.1 inches at a 3 inch radius to 23.2 inches at a 4 inch radius to 23.3 inches at a 5 inch radius and then decreases to 23.0 inches at a 6 inch radius.

Blades b1 and b3 have increasing pitch with increasing radii all the way to the outer tip of the blade. Blade b2 has increasing pitch from the 3 inch radius to the 5 inch radius, as seen by the increase of pitch from 22.9 inches to 23.0 inches to 23.4 inches; however, from the 5 inch radius to the 6 inch radius, the pitch of the pressure surface of blade b2 decreases from 23.4 inches to 23.0 inches. The increasing pitch with increasing radii from the 3 inch radius to the 5 inch radius and then the decreasing pitch with increasing radii from the 5 inch radius to the 6 inch radius provides a hump in the pressure surface at the 5 inch radius of blade b2 between portions of increasing and decreasing pitch with increasing radii. The portion of increasing pitch is between the 3 inch radius and the 5 inch radius. The portion of decreasing pitch is between the 5 inch radius and the 6 inch radius and continues to the outer tip which has a radius of 7.3 inches. Blades b4 and b5 likewise have increasing pitch to the 5 inch radius and then decreasing pitch thereafter with increasing radii.

It is desired in the present invention to have increasing pitch part of the way and then decreasing pitch the rest of the way to the outer tip in combination with the other noted aspects of blade pressure surface contour including increasing progressiveness of pitch with increasing radii. Blades b2, b4 and b5 are thus preferred. However, it is difficult to control thermal warpage of the blade at the outer tip upon leaving the master mold. Hence, some of the blades, such as b1 and b3 increase in pitch all the way to the outer tip of the blade, whereas other blades such as b2, b4, b5 have outer portions with decreasing pitch. This has been found to be acceptable as long as at least the major portion of the blade pressure surface has the noted increasing pitch with increasing radii in the five blade marine propeller shown and in combination with the other noted blade pressure surface contour characteristics. It is preferred that progressiveness of pitch for all blades increase with increasing radii all the way to the outer tip of the blade.

The disclosed five blade propeller has been found to provide significant performance advantages particularly in 75, 90, 100 and 115 horsepower Mercury and Mariner Outboards, Mercury 150 XR4 and Mariner 150 Magnum II, V-6 Mercury and Mariner Outboards, and Merc Cruiser Alpha One and Bravo One Stern Drives. The propeller delivers quicker acceleration, shorter on-plane time, reduced vibration, and optimum bow lift at top speeds. Other advantages include increased trim-out capability and top-end wide-open throttle performance. In addition, less water depth is needed to plane the boat, and a planing attitude can be maintained at lower speeds/RPMs. Furthermore, the propeller exhibits superior holding ability in tight turns and rough water.

It is recognized that various equivalents, alternatives and modifications are possible within the scope of the appended claims.

We claim:

1. A five blade marine propeller comprising a hub having five blades extending generally radially outwardly therefrom to respective outer tips, each of the five blades having a leading edge and a trailing edge, each of the five blades having a contoured pressure surface between said hub and said outer tip and between said leading edge and said trailing edge, each of the five blades having a progressive pitch from said leading edge to said trailing edge along a given radius from the axis of rotation of the propeller, in combination with both increasing pitch and increasing progressiveness of pitch along at least a portion of increasing radii from said given radius, wherein said propeller has two types of blades among said five blades, a first type blade having increasing pitch with increasing radii from said given radius all the way to said outer tip, and a second type blade having increasing pitch with increasing radii from said given radius to a second given radius and then decreasing pitch with increasing radii from said second given radius, each of said first and second blade types being included among the five blades of said propeller.

2. A five blade marine propeller comprising a hub having five blades extending generally radially outwardly therefrom to respective outer tips, each of the five blades having a leading edge and a trailing edge, each of the five blades having a contoured pressure surface between said hub and said outer tip and between said leading edge and said trailing edge; each of the five blades having a progressive pitch from said leading edge to said trailing edge along a given radius from the axis of rotation of the propeller, in combination with both increasing pitch and increasing progressiveness of pitch along at least a portion of increasing radii from said given radius, wherein pitch for at least one of said five blades increases with increasing radii from said given radius to a second given radius, and then decreases with increasing radii from said second given radius, to provide a hump in said pressure surface at said second given radius between portions of increasing and decreasing pitch with increasing radii.

* * * * *